US005874990A

United States Patent [19]

Kato

[11] Patent Number: 5,874,990

[45] Date of Patent: Feb. 23, 1999

[54] SUPERVISORY CAMERA SYSTEM

[75] Inventor: Toshifumi Kato, Shizuoka, Japan

[73] Assignee: Star Micronics, Inc., Shizuoko, Japan

[21] Appl. No.: 824,038

[22] Filed: Mar. 26, 1997

[30] Foreign Application Priority Data

Apr. 1, 1996 [JP] Japan ..... 8-078940

[51] Int. Cl.[6] ..... H04H 7/18

[52] U.S. Cl. ..... 348/139; 348/143

[58] Field of Search ..... 348/143, 153, 348/159, 15, 152, 211, 213, 154; 370/85.1; 380/28; H04N 7/18

[56] References Cited

U.S. PATENT DOCUMENTS

| | | | |
|---|---|---|---|
| 3,757,039 | 9/1973 | Brewer | 348/159 |
| 4,001,881 | 1/1977 | Filsom | 348/159 |
| 4,037,250 | 7/1977 | McGahan et al. | 348/159 |
| 4,308,559 | 12/1981 | Schiff | 348/159 |
| 5,264,929 | 11/1993 | Yamaguchi | 348/159 |
| 5,359,363 | 10/1994 | Kuban et al. | 348/143 |
| 5,402,167 | 3/1995 | Einbinder | 348/143 |

FOREIGN PATENT DOCUMENTS

| | | |
|---|---|---|
| 2 601 215 A | 1/1988 | European Pat. Off. . |
| 2 633 134 A | 12/1989 | European Pat. Off. . |
| Hei 6-006644 | 1/1994 | Japan . |

*Primary Examiner*—Jeffrey R. Jastrzab
*Assistant Examiner*—Luanne P. Din
*Attorney, Agent, or Firm*—Samuels, Gauthier & Stevens

[57] ABSTRACT

A supervisory system in which a plurality of supervisory points (1) to (N) are monitored one after another by a monitor camera. The supervisory points are switched at random based on random numbers. A period of monitoring each supervisory point is set at random based on the random numbers. When random monitoring is carried out, it is controlled in order not to select the same supervisory point in succession.

14 Claims, 9 Drawing Sheets

| SUPER-VISORY POINT | PANNING COORDINATES | TILTING COORDINATES | ZOOMING VALUE | Pos VALUE |
|---|---|---|---|---|
| 1 | 84° | 45° | 24 mm (x4) | 0 |
| 2 | 23° | 32° | 36 mm (x6) | 1 |
| 3 | 197° | 27° | 72 mm (x12) | 2 |
| ⋮ | ⋮ | ⋮ | ⋮ | ⋮ |
| N | 225° | 50° | 6 mm (x1) | N-1 |

Fig. 5

SUPERVISORY CAMERA SYSTEM

BACKGROUND OF THE INVENTION

1. Field of the Invention

The present invention relates to a supervisory camera system which is installed in various facilities, such as public facilities, stores and banking facilities, for the purpose of preventing crimes.

2. Description of the Related Art

A supervisory camera system is a system which monitors a supervisory area using a monitor camera. The system is generally installed in facilities of every kind which particularly require crime prevention, for example banks. Among conventional systems, there is a system in which an individual monitor camera is installed at every supervisory point. There is also another system in which a single monitor camera monitors a plurality of supervisory points in consideration of a reduction in system costs and limitation of the installation space.

In the latter system, a plurality of supervisory points previously set are monitored one by one in a prescribed order by a single monitor camera. Whenever a supervisory point is switched to another, a control function of the system is activated to change a posture of the monitor camera, a zooming extent, or the like.

However, in the conventional systems described above, there is a possibility that a person who attempts to commit a crime will learn the switching order of the supervisory points and the monitoring cycle if he or she observes the cyclic operation of the monitor camera for a while. Therefore, there is a fear of his or her conducting criminal activities during the intervals of supervision.

More specifically, in the conventional systems, the monitor camera operates in a regular manner and therefore future movements of the monitor camera can be easily predicted. Under such circumstances, there is a great need for a supervisory camera system which is very effective during preventing crimes.

In the Official Gazette of Japanese Patent Laid-Open Publication No. Hei 6-6644, a system related to household portable cameras is disclosed. In this conventional system, a portable video camera is mounted in a mechanism which holds the camera in such a manner that the camera is capable of rotating and going up and down. The constitution is such that the directions of image pickup and zooming extent of the camera can be easily adjusted by a remote control operation. Also in this system, a random number generator for generating random numbers every prescribed number of seconds is installed. Based on the random numbers generated, the directions of image pickup and zooming extent of the camera are automatically varied. However, the object of using these random numbers in this conventional system is to produce eye-catching video products. In this conventional system, images are picked up from random directions and changeovers of image pickup directions are performed at fixed intervals. Therefore, this conventional system is not suitable for supervisory purposes.

SUMMARY OF THE INVENTION

The present invention has been made in light of the problems of the conventional systems described above. An object of the present invention is to provide a supervisory camera system which helps to prevent the occurrence of criminal activities. This is done by making it difficult or impossible for a person who attempts to commit a crime to predict the movement of a monitor camera.

Another object of the present invention is to provide a supervisory camera system which makes it difficult to predict not only monitoring directions but also a period of monitoring each supervisory point at a time.

The other object of the present invention is to provide a supervisory camera system which does not take an excessive time period of monitoring the same supervisory point during random monitoring of a plurality of supervisory points.

In order to achieve the aforementioned objects, the present invention comprising: a monitor camera; random number generating means for generating random numbers; supervisory point selecting means for selecting at random a plurality of supervisory points one by one based on the aforementioned random numbers; and monitor control means for controlling movements of the aforementioned monitor camera which causes the camera to monitor the supervisory points selected.

In the constitution described above, the supervisory point selecting means selects a supervisory point to be monitored next or supervisory points to be monitored in the future based on random numbers generated by the random number generating means. The monitor control means causes the monitor camera to monitor the supervisory points selected.

In the present invention, as changeovers of a plurality of supervisory points are carried out at random, it is difficult or impossible for a person who attempts to commit a crime to predict movements of the monitor camera. Therefore, it is very effective in preventing crimes.

In a preferred embodiment of the present invention, a table for defining moving conditions of the aforementioned monitor camera corresponding to each of the supervisory points is provided. The aforementioned monitor control means controls the movements of the monitor camera by referring to the table.

It is preferable that the moving conditions described above include at least one of a number of values, such as a panning value (panning coordinates), a tilting value (tilting coordinates), and a zooming value.

In the preferred embodiment of the present invention, the aforementioned monitor control means has a function of setting at random a period of monitoring each supervisory point based on random numbers.

If random control of monitoring periods is carried out in addition to random changeovers of supervisory points, it will become more difficult to predict movements of the monitor camera. A minimum value and a maximum value of the monitoring period can be optionally set, and the monitoring period is set at random within the range.

In the preferred embodiment of the present invention, if current moving conditions and the subsequent moving conditions of the aforementioned monitor camera coincide with each other, the aforementioned monitor control means will make a random selection of the subsequent moving conditions once more.

If the same supervisory point is accidentally selected in succession based on the random numbers, a period of monitoring a single supervisory point will be excessively prolonged. However, if a selection of moving conditions is made once more as described above, the aforementioned problem will not arise.

In the concept of the aforementioned moving conditions, every sort of condition, such as a condition of controlling posture of the monitor camera or a condition of image pickup, is included. In addition to the aforementioned panning value, tilting value, zooming value, and monitoring period, for example, parameters, such as extent of focus, aperture size, or selection of lens, will be included as occasion demands.

A system for successively monitoring a plurality of supervisory points by scanning is included in the preferred embodiment of the present invention.

The present invention is applicable to a system having a plurality of monitor cameras as well as a system having a single monitor camera. In the case of the former system, the aforementioned random control is applied to a plurality of cameras or to a single camera among them. In such a system, if a plurality of monitor cameras under random control, for example two cameras, accidentally select the same supervisory point, it will be preferable to detect the coincidence and cause one of the cameras to select another supervisory point again. Thus, an efficient supervisory system can be secured.

BRIEF DESCRIPTION OF THE DRAWINGS

FIG. 5 is a table showing contents of a moving condition table.

DESCRIPTION OF THE PREFERRED EMBODIMENT

Figure 1:
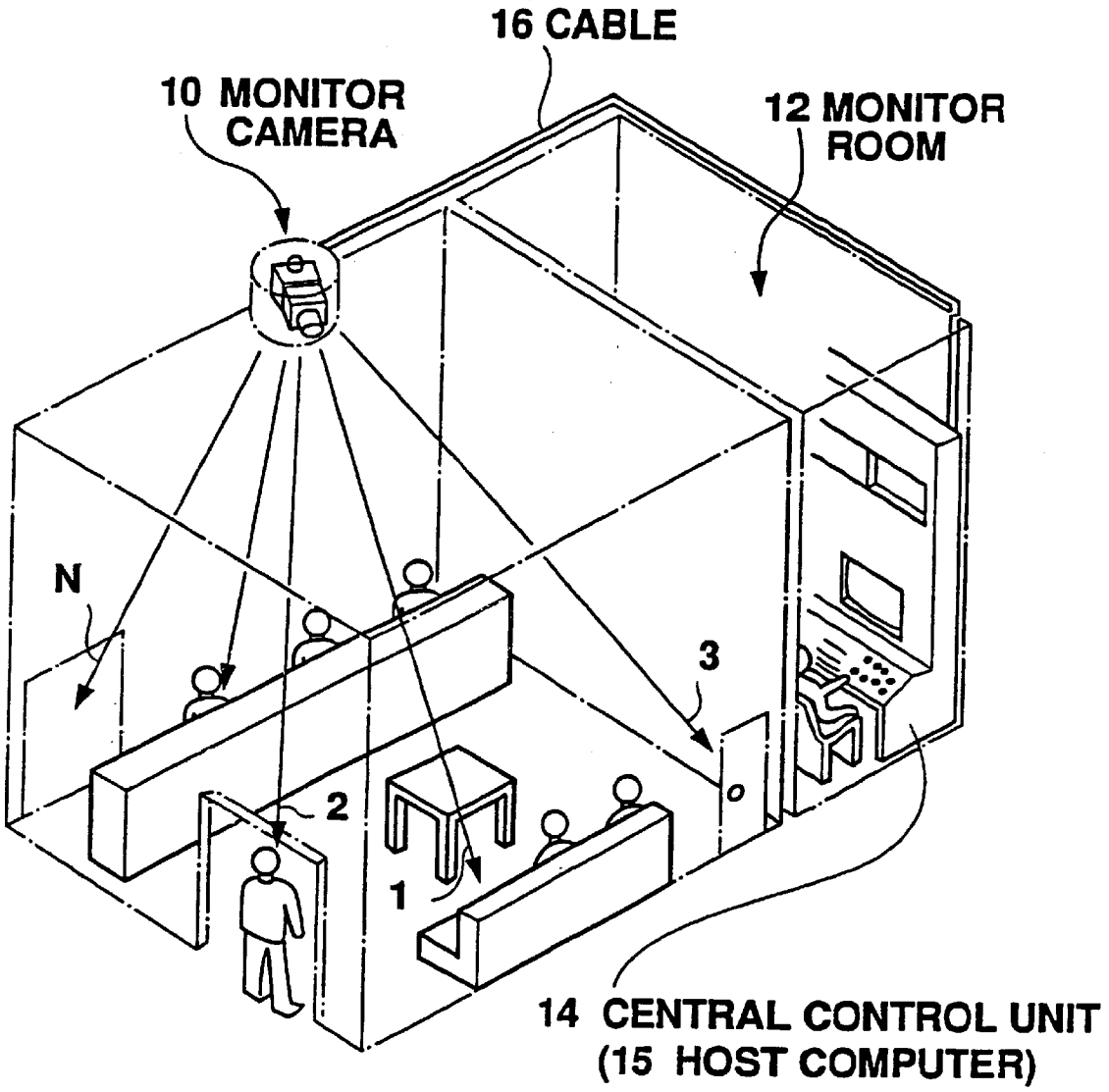
FIG. 1 is a diagram illustrating a supervisory camera system in a state of being installed according to the present invention.

FIG. 1 shows the state of a facility in which a supervisory camera system is installed according to the present invention.

This facility is, for example, a banking facility. A monitor camera 10 is fitted to a ceiling of the facility. The monitor camera 10 monitors a plurality of supervisory points (1) to (N) in the facility. As shown in FIG. 1, the monitor camera 10 may be stored in a transparent dome. This monitor camera 10 is kept in a variable posture mechanism. Thus, the posture of the monitor camera is freely varied so that an image of each supervisory point can be picked up.

In an example shown in FIG. 1, a monitor room 12 is provided adjacent to a room in which the monitor camera 10 is installed. In the monitor room 12, there is installed a central control unit 14 having a host computer 15 which is operated by a supervisor. The central control unit 14 is connected with the monitor camera 10 by means of a cable 16. Operations of the monitor camera 10 can be controlled from the central control unit 14. When a video signal is transmitted to the central control unit 14, an image is projected onto a monitor screen.

In the example shown in FIG. 1, a single monitor camera is illustrated. However, a plurality of monitor cameras 10-1 to 10-n are usually installed in the facility. Even in such a case, it is preferable to apply random control (which will be described later) to each monitor camera.

The supervisory points (1) to (N) are set in areas which require supervision for the purpose of crime prevention, such as entrances for customers, counters, waiting areas, and areas in front of a vault. It is a matter of course that each supervisory point can be optionally selected.

Figure 2:
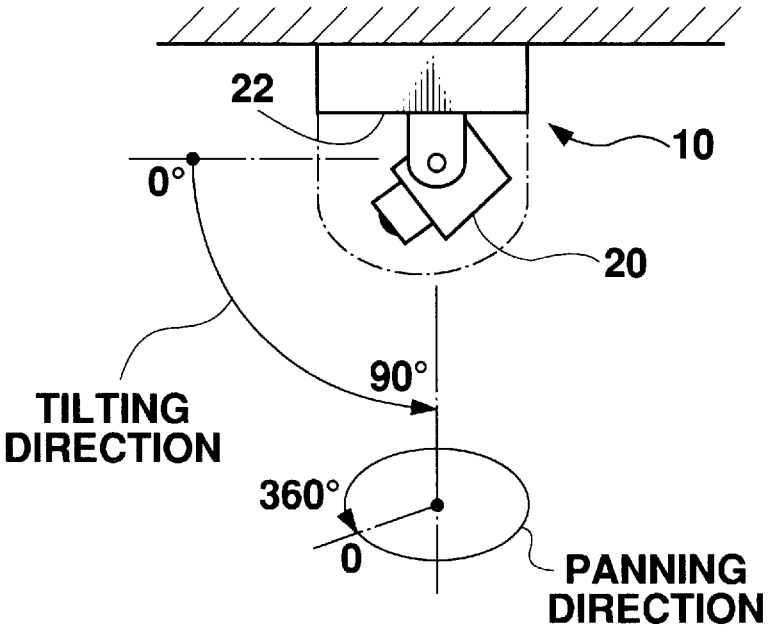
FIG. 2 is a diagram illustrating the constitution of a monitor camera.

FIG. 2 illustrates the structure of the monitor camera 10 shown in FIG. 1. A body (20) of the monitor camera is kept in a mechanism 22. Due to the mechanism 22, postures of the body 20 can be freely varied with respect to both a tilting direction and a panning direction. As will be described later, it is possible to freely control a zooming extent of the body 20.

As shown in the drawing, the posture of the body 20 of the monitor camera can be varied within the range of 90 degrees with respect to the tilting direction. With respect to the panning direction, the posture of the body 20 can be varied through 360 degrees. A tilting value and a panning value set for the monitor camera 10 are detected by a sensor which will be described later. The monitor camera 10 is provided with a zooming mechanism. By utilization of this zooming mechanism, an angle of view is adjusted, in other words, an image can be picked up by a telephoto shot as well as a wide-angle shot.

In this embodiment, the body 20 in which a 0.25-inch charge coupled device (CCD) is built is used. With regard to its optical system, the focal length can be varied within the range of 6 mm to 72 mm.

Figure 3:
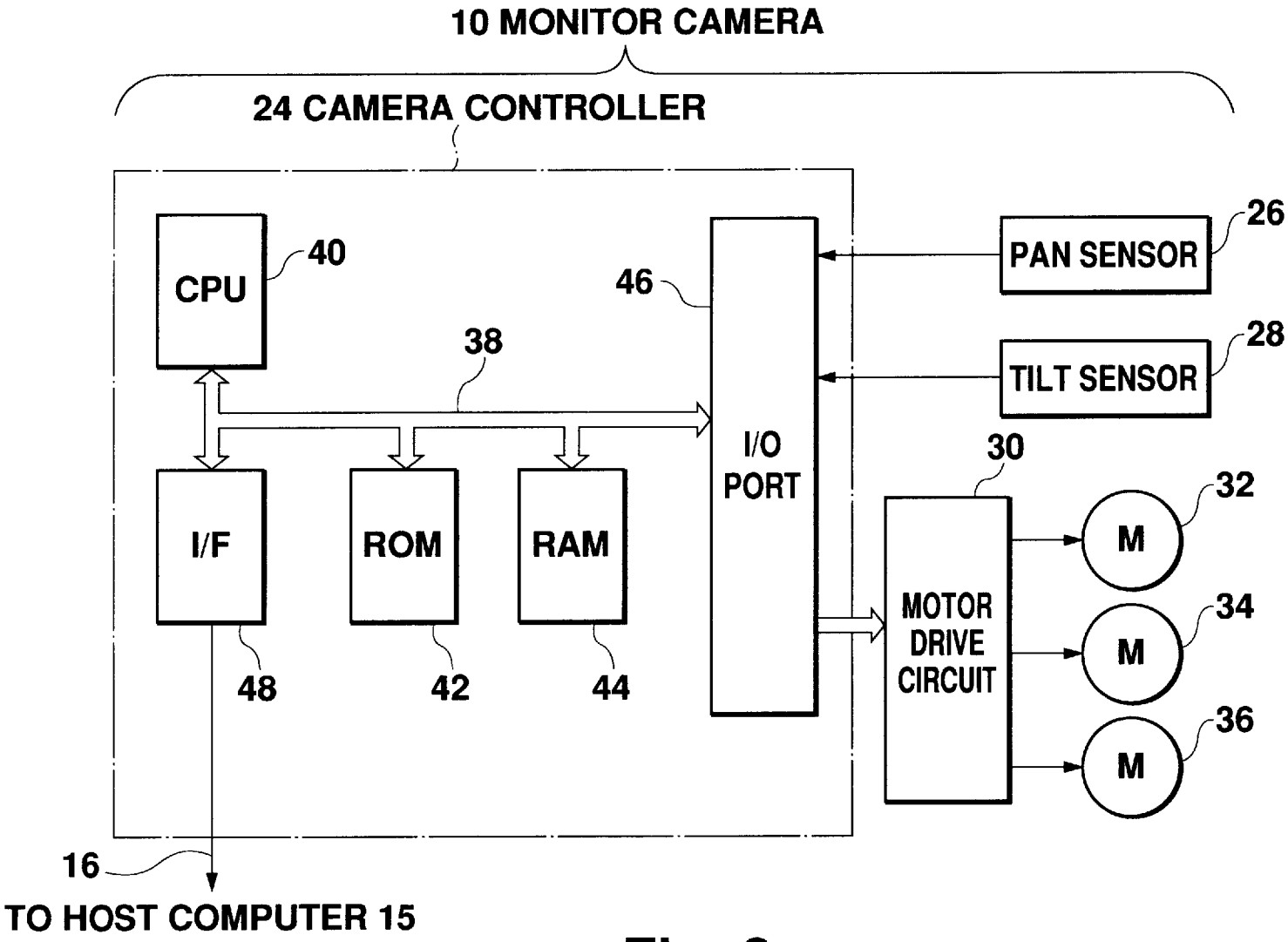
FIG. 3 is a block diagram of a monitor camera.

FIG. 3 is a block diagram of the monitor camera 10 which is shown in FIG. 1.

A camera controller 24 is composed of a microcomputer, for example. A pan sensor 26 and a tilt sensor 28 are connected to the camera controller 24. Signals from these sensors 26 and 28 are used for positioning at the time of initialization of the mechanism 22 (see FIG. 2). The camera controller 24 is connected with a motor drive circuit 30. Through the motor drive circuit 30, a pan motor 32 for driving with respect to a panning direction, a tilt motor 34 for driving with respect to a tilting direction, and a zoom motor 36 for zooming can be separately controlled.

The camera controller 24 includes a CPU 40, a ROM 42, a RAM 44, an input/output (I/O) port 46, and an interface (I/F) circuit 48. These components are connected with an internal bus 38. In the ROM 42, a program necessary for controlling movements of each mechanism (including the mechanism 22) of the monitor camera is stored. A storage region necessary for operating the program is formed in the RAM 44. Instead of using the ROM 42, the program may be made to download to the RAM 44 from a memory medium (for example, a floppy disk) in which the program is stored.

The CPU 40 controls the monitor camera 10 based on the program. Each signal from sensors 26 and 28 is inputted to the CPU 40 via the I/O port 46. A drive signal from the CPU 40 is outputted to the motor drive circuit 30 via the I/O port 46. The host computer 15 of the central control unit 14 is connected to the CPU 40 via the I/F 48.

Figure 4:
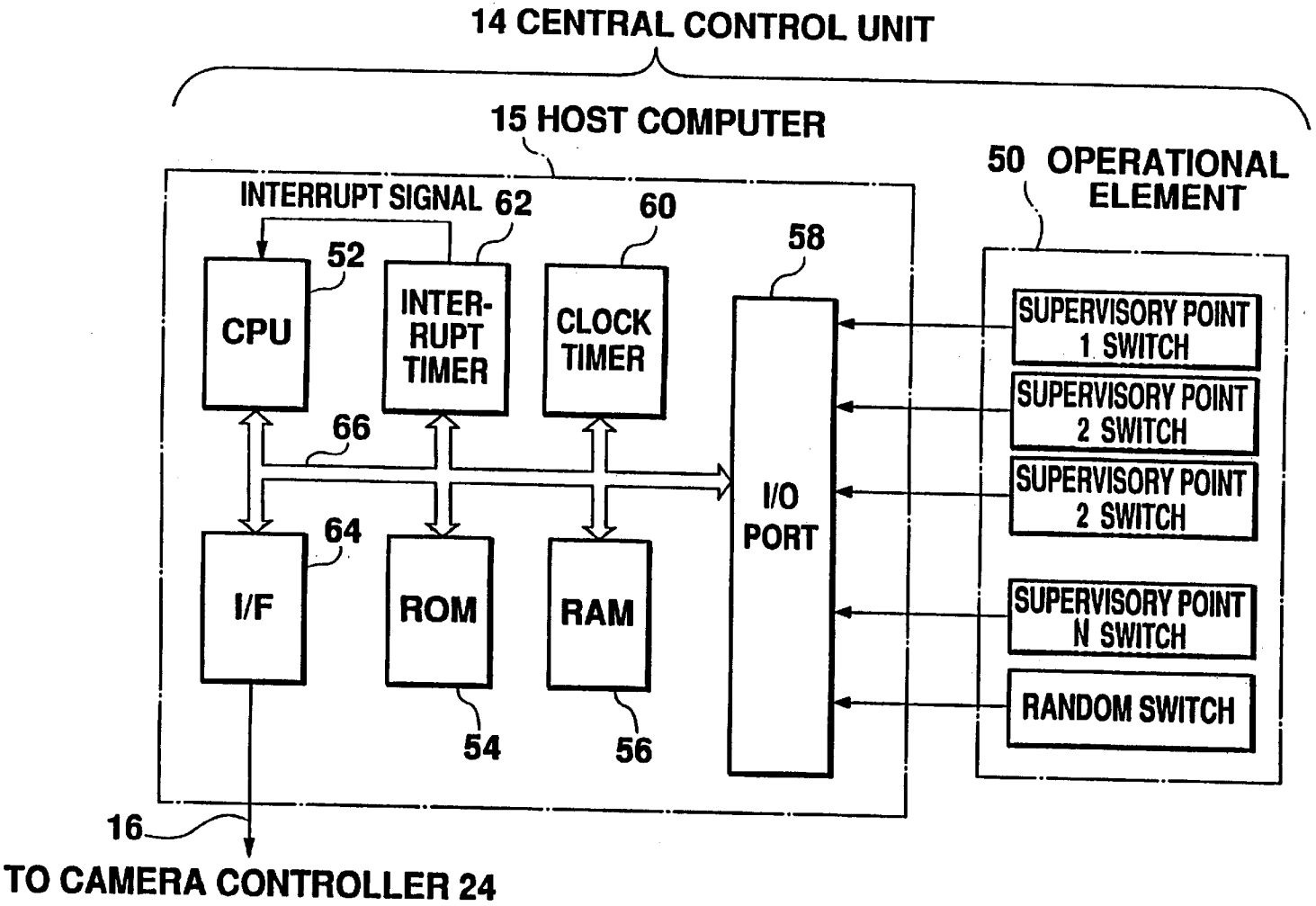
FIG. 4 is a block diagram of a central control unit.

FIG. 4 is a block diagram of the central control unit 14 which is shown in FIG. 1. This central control unit 14 is divided broadly into the host computer 15 and a operational element 50. A monitor and an image recording device or the like are not shown in the drawings.

The operational element 50 includes a plurality of switches. Concretely, switches (1) to (N) for designating the supervisory points (1) to (N) and a random switch for random monitoring are included.

In the supervisory system according to this embodiment, a random monitoring mode is generally adopted as will be described later. By operating switches (1) to (N) as occasion demands, it is possible to switch to an individual monitoring mode. In this case, restoration from the individual monitoring mode to the random monitoring mode is made automatically or by operating the aforementioned random switch. For example, it is preferable to set such a control condition that when a prescribed time period elapses after commencement of the individual mode, the restoration to the random monitoring mode is made automatically.

The host computer 15 is composed of a CPU 52, a ROM 54, a RAM 56, an I/O port 58, a clock timer 60, an interrupt timer 62, and an I/F 64. These components are connected to an internal bus 66. In the ROM 54, both a program for controlling the whole system and a program for controlling the monitor camera by detecting an input from the operational element 50 are stored. A memory region necessary for carrying out the system control program is formed in the RAM 56. The clock timer 60 is used for limiting a period of monitoring a specified supervisory point to a definite time period when the individual monitoring mode is carried out. The interrupt timer 62 is a circuit for causing the CPU 52 to generate an interrupt. When a time period set to the interrupt timer 62 elapses, an interrupt signal is outputted to the CPU 52. The aforementioned operational element 50 is connected to the I/O port 58. A cable 16 is connected to the I/F 64. A control signal (a command) is transmitted from the host computer 15 to the camera controller 24 (see FIG. 3) via the cable 16. Also via the cable 16, an image signal or the like is transmitted from the camera controller 24 to the host computer 15. The CPU 52 also functions as a random number generator as will be described later.

FIG. 5 shows the contents of a moving condition table stored in the ROM 54 which is shown in FIG. 4.

The CPU 52 refers to this moving condition table when the movement of the monitor camera is controlled. In this moving condition table, each of the panning coordinates, tilting coordinates, and a zooming value corresponds to each of the supervisory points (1) to (N) as moving conditions of the monitor camera 10 at the time of monitoring the supervisory points. A positioning (Pos) value corresponding to each supervisory point is used as an index value of each supervisory point. The supervisory points and the moving conditions are set and revised at the discretion of the operator.

Figure 6:
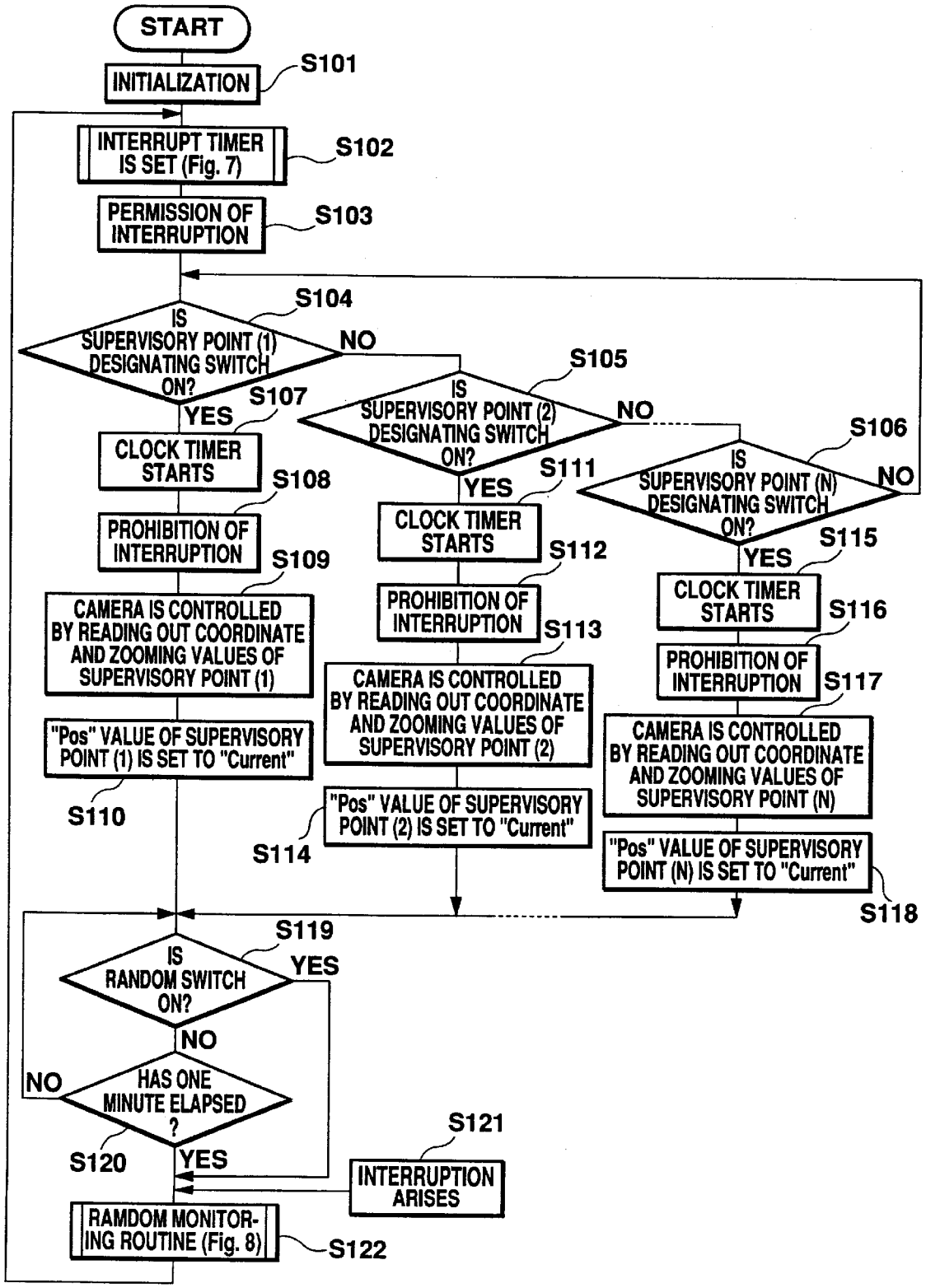
FIG. 6 is a flowchart showing the operation of a host computer.

In FIG. 6, a main movement of the host computer 15 is shown as a flowchart.

At Step 101, initialization is performed. In this initializing process, setting of the prohibition of interruption is included. At Step 102, the interrupt timer 62 is set in order to operate the monitor camera 10 in a random monitoring mode.

Figure 7:
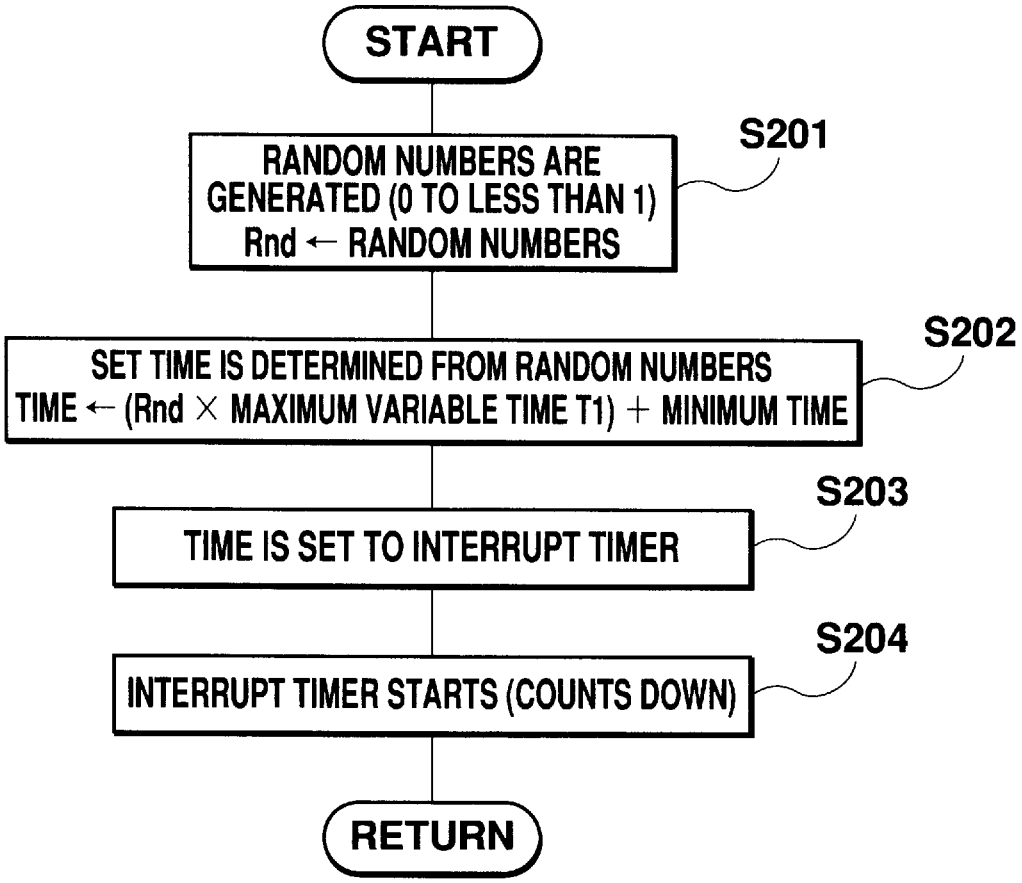
FIG. 7 is a flowchart showing concrete contents of a routine (S102) for setting an interrupt timer which is given in FIG. 6.

Details of the setting are shown in FIG. 7. In other words, FIG. 7 is a flowchart showing a routine for setting an interrupt timer.

At Step 201, a random number is generated within the range of 0 to less than 1. This random number is substituted for a variable "Rnd." At Step 202, a set time "Time" is calculated on the assumption that a minimum time is added to the product of (a variable "Rnd"×a maximum variable time "T1"). Here, if the maximum variable time "T1" is set to 20 seconds and a minimum time is set to 1 second, for example, the set time "Time" will be calculated at random within the range of 1 to 21 seconds. A value of each coefficient is stored, for example, in the RAM 56. At Step 203, the set time "Time" calculated at Step 202 is set to the interrupt timer 62. Then, at Step 204, the interrupt timer 62 begins to count down starting from the set time "Time." Thus, after commencement of the interrupt timer 62, the processing program is returned to the routine shown in FIG. 6.

At Step 103 shown in FIG. 6, the prohibition of interruption is withdrawn, and therefore interruption is permitted. At Steps 104, 105 and 106, it is determined whether or not any of the switches in the operational element 50 which are corresponding to the supervisory points has been operated. If it is determined that no switch has been operated, the processing program will be in a standby mode awaiting an input.

In such a waiting condition, if the interrupt timer 62 reaches zero and generates an interrupt signal, the CPU 52 will detect it. Then, the processing program will jump into Step 121 and a random monitoring routine will be carried out at Step 122.

Figure 8:
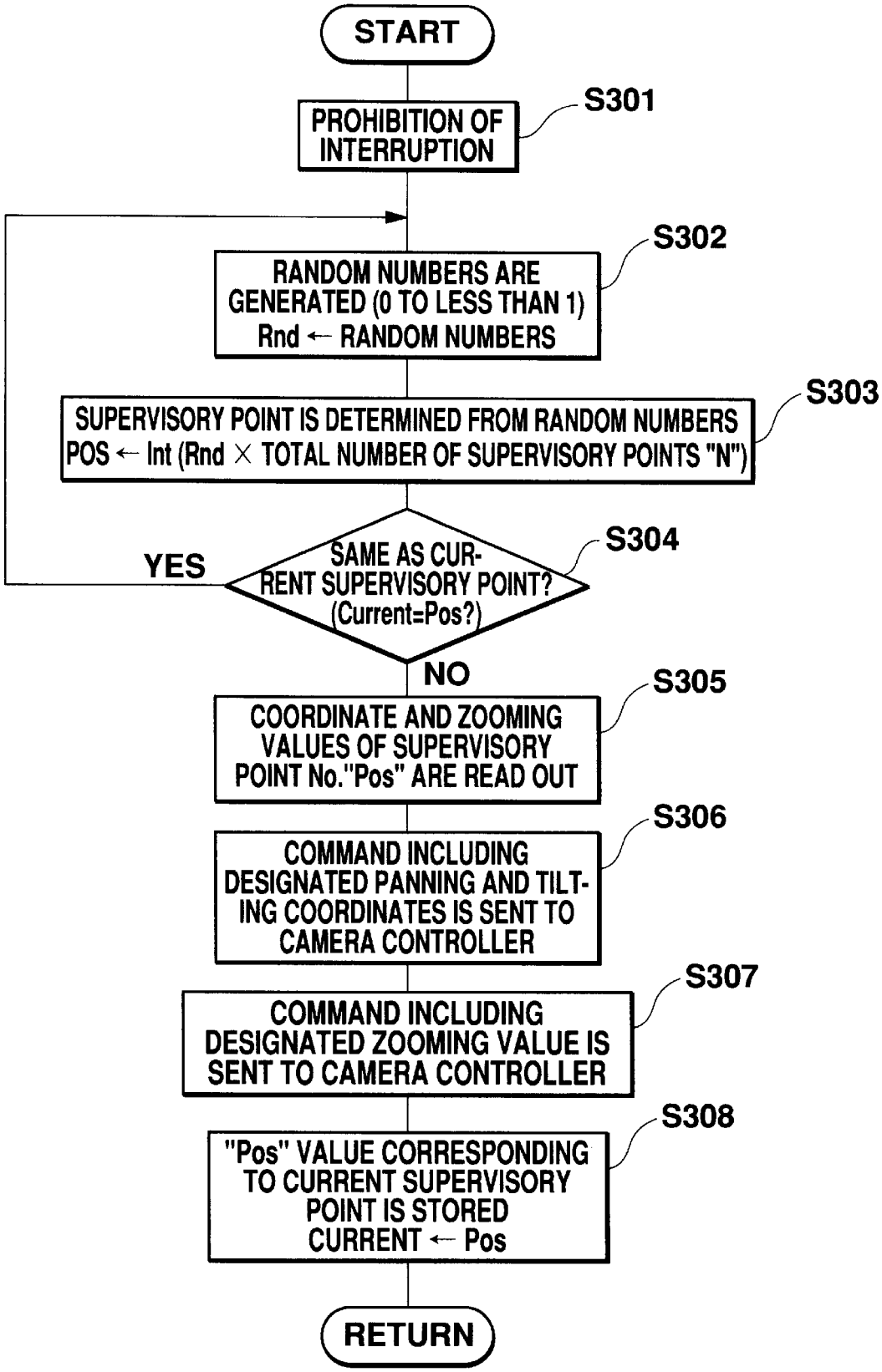
FIG. 8 is a flowchart showing concrete contents of a random monitoring routine (S122) which is given in FIG. 6.

In FIG. 8, the contents of such a random monitoring routine are shown as a flowchart.

At Step 301, interruption is prohibited so as to prevent new interruption from arising. At Step 302, a random number is generated within the range of 0 to less than 1. The random number is substituted for the coefficient "Rnd." At Step 303, the coefficient "Rnd" is multiplied by the total number "N" of the supervisory points, and an integer part of the product is extracted. The integer part is substituted for "Pos." At Step 304, for the purpose of determining whether or not the current supervisory point "Current" coincides with the next supervisory point "Pos," these two supervisory points are compared. If there is coincidence, the processing program will return to Step 302 and repeat the above processing in order not to excessively prolong monitoring of the same supervisory point.

On the other hand, if it is determined at Step 304 that these two supervisory points do not coincide with each other, the moving condition table will be referred to at Step 305. Then, the moving condition of a supervisory point No. "Pos" will be read out. Concretely, the panning coordinates, tilting coordinates and a zooming value will be read out. At Step 306, a command including the panning coordinates and tilting coordinates will be transmitted from the host computer 15 to the camera controller 24. At Step 307, a command including the zooming value read out will be transferred from the host computer 15 to the camera controller. At Step 308, "Pos" which shows the current supervisory point will be substituted for "Current" and "Current" will be renewed. When this routine is finished, in other words, when the random monitoring routine at Step 122 shown in FIG. 6 is finished, each processing starting at Step 102 shown in FIG. 6 will be repeatedly executed.

Operation (operation of an individual monitoring mode) in such a case that any one of the switches is operated during the processing at Steps 104 to 106 will be subsequently explained.

For example, if the switch (1) for the supervisory point (1) is operated, it will be detected at Step 104. Then, the clock timer 60 will start at Step 107. At Step 108, interruption will be prohibited. At Step 109, the moving condition table (see FIG. 5) will be referred to and the moving conditions (panning coordinates, tilting coordinates and a zooming value) of the supervisory point (1) will be read out. Then, a command including the moving conditions will be outputted from the host computer 15 to the camera controller 24. Thus, the monitor camera 10 will monitor the supervisory point (1). At Step 110, the "Pos" value of the supervisory point (1)

will be substituted for "Current," and it will then be stored. This is for determining at the next random monitoring, if the same supervisory point is selected in succession.

Likewise, if the switch (2) for the supervisory point (2) is operated, it will be detected at Step 105. At Step 111, the clock timer 60 will start counting down. At Step 108, interruption will be prohibited. Then at Step 113, moving conditions of supervisory point (2) will be read out. As a result, the monitor camera 10 performs monitoring of the supervisory point (2). At Step 114, the "Pos" value of the supervisory point (2) will be substituted for "Current" and stored.

The aforementioned operation is applied to the case of other supervisory points. For example, if a supervisory point (N) is designated, it will be detected at Step 106. The processing program will then advance to Step 117 via Steps 115 and 116 so that monitoring of the supervisory point (N) is carried out. At Step 118, a value "Pos" of the supervisory point (N) will be substituted for "Current" and stored.

At Step 119, it is determined whether or not the random switch has been operated. If the switch has been operated, the individual monitoring mode will be mandatorily terminated, and the aforementioned random monitoring routine will be executed at Step 122. On the other hand, if it is determined at Step 119 that the random switch has not been operated, it will be determined at Step 120 whether or not a period of one minute which is set for the clock timer 60 has elapsed. In other words, in this embodiment, a maximum period of monitoring any one of the supervisory points is set to one minute in the individual monitoring mode. Until one minute elapses, monitoring of a designated supervisory point will be carried out. The processing program will then return to the random monitoring mode at Step 122.

In the random monitoring described above, the supervisory points are switched one after another at intervals of a time period which is set at random, for example, one to twenty-one seconds. Moreover, as changeovers of the supervisory points are performed in a random order, it is impossible to predict movements of the monitor camera.

Further, during the random monitoring mode or at the time of switching the individual monitoring mode to the random monitoring mode, it is possible to avoid the fact that the same supervisory point is monitored in succession. Therefore, it is possible to prevent such a problem that a period of monitoring any one of the supervisory points is excessively prolonged and therefore a period of monitoring any other supervisory point is extremely shortened.

In this embodiment, it is also possible that with the random monitoring mode executing at all times, the individual mode is executed as occasion demands.

Figure 9:
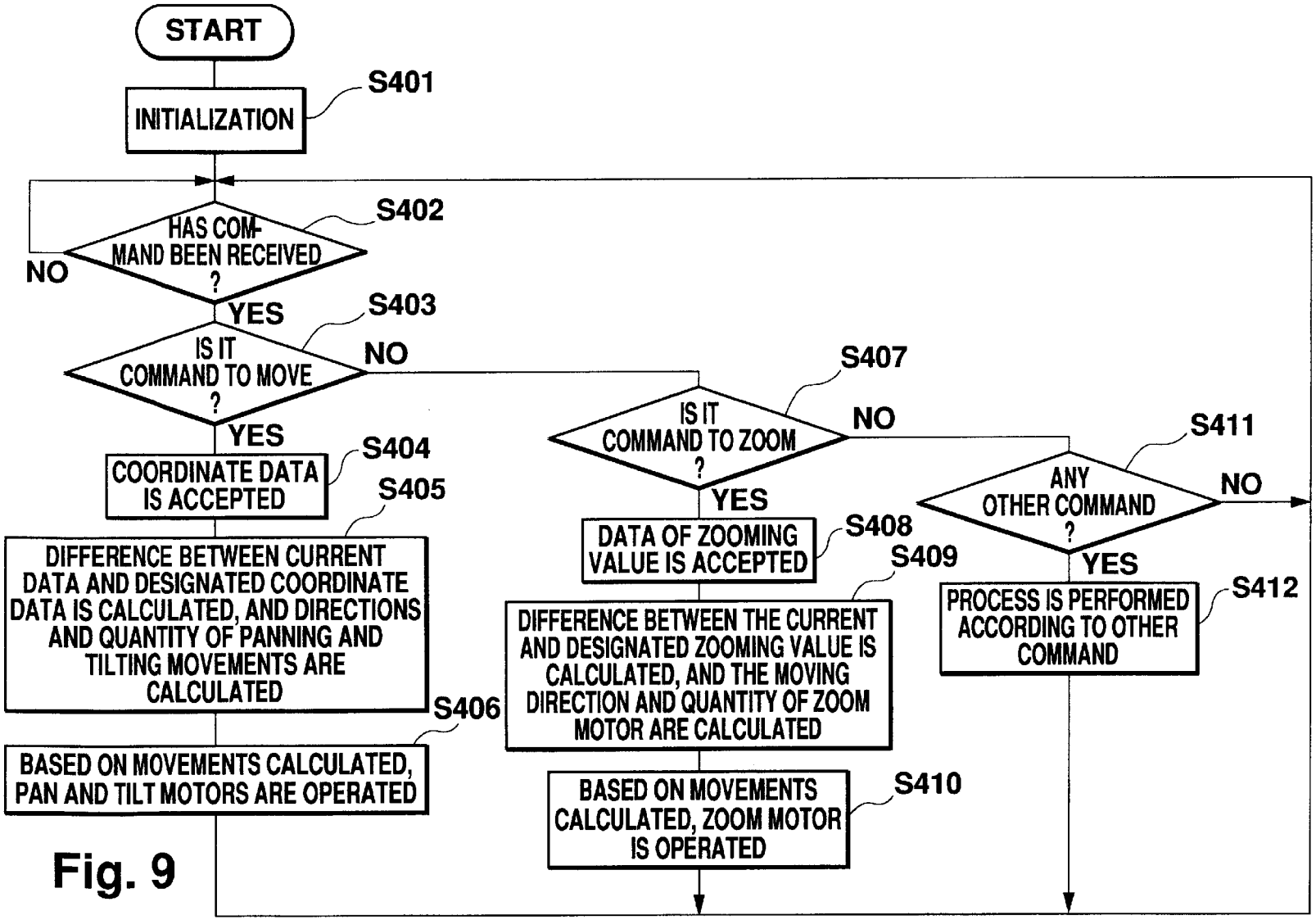
FIG. 9 is a flowchart showing the operation of a camera controller.

In FIG. 9, the operation of the camera controller 24 is shown as a flowchart.

At Step 401, initialization is performed. At the next Step 402, it is determined whether or not a command from the host computer 15 has been received. The processing program is kept in standby mode until reception of the command. If a command received is related to control of a camera posture, such as panning or tilting, it will be detected at Step 403. At the next Step 404, information about coordinates (panning coordinates and tilting coordinates) received will be accepted. Then at Step 405, a difference between a current coordinate data and a designated coordinate data will be figured out. Based on the difference calculated, a variation of camera posture will be determined. In other words, panning quantity and tilting quantity will be calculated in order for the camera posture to be variable. At Step 406, the pan motor 32 and the tilt motor 34 are driven based on a moving direction and quantity of movement which are calculated at Step 405. Thus, the object to be monitored will be switched from a supervisory point being monitored at present to a designated supervisory point.

If the command received is a command related to zooming, it will be detected at Step 407. At the next Step 408, a zooming value received will be read out. Then, at Step 409, a difference between a current zooming value and a designated zooming value will be figured out. Then a moving direction and moving extent of the zoom motor 36 will be determined based on the difference calculated. At Step 410, based on the extent of movement determined, the zoom motor will be driven.

If panning coordinates, tilting coordinates and a zooming value are simultaneously received, a process from Step 403 to Step 406 and a process from Step 407 to Step 410 are simultaneously carried out.

If another command is received at Step 402, it will be detected at Step 411. At the next Step 412, a process according to the command will be carried out. After completion of a process according to each command, the processing program will return to Step 402 again in which the arrival of command is awaited.

In the embodiment described above, random numbers are used for switching the supervisory points and setting a period of monitoring each supervisory point. However, utilization of random numbers only for switching the supervisory points is enough to make it difficult to predict the monitoring order. This will enhance the effect on crime prevention. Further, if the random numbers are also used for setting a period of monitoring each supervisory point, the effect on crime prevention will be further enhanced. Therefore, the present invention is effective in preventing criminal activities which may be performed taking advantage of a blind shot of the monitor camera.

In the aforementioned embodiment, the moving condition table is stored in the ROM. It is preferable to have a constitution in which contents of the table can be added or revised by the supervisor's input operation. Also in this embodiment, random monitoring is performed by the monitor camera in accordance with instructions from the host computer. However, the present invention is not limited to this. It is also preferable to provide the monitor camera with a circuit by which random monitoring is carried out in accordance with commands from outside.

As described above, in the aforementioned constitution, random monitoring based on random numbers makes it difficult for a person who attempts to commit a crime to predict movements of the monitor camera. Consequently, it enhances the effect on crime prevention.

Further, in the aforementioned constitution, it is difficult to predict not only monitoring directions, but also a period of monitoring each supervisory point at a time.

Also in the aforementioned constitution, it is possible to solve such a problem that during the period of monitoring a plurality of the supervisory points at random, a period of monitoring the same supervisory point is excessively prolonged.

While there has been described what are at present considered to be preferred embodiment of the invention, it will be understood that various modifications maybe made thereto, and it is intended that the appended claims cover all such modifications as fall within the true spirit and scope of the invention.

What is claimed is:

1. A supervisory camera system comprising:

a monitor camera;

means for generating a random number;

means for selecting at random one of a plurality of predetermined supervisory points based on said random number, for comparing said selected predetermined supervisory point against the previous selected supervisory point, and for randomly reselecting another predetermined supervisory point if said selected predetermined supervisory point and the previously selected supervisory point are the same to ensure the same supervisory point is not monitored two consecutive time periods; and monitor control means for controlling movements of said monitor camera which causes said camera to monitor said selected predetermined supervisory point.

2. The supervisory camera system according to claim 1 further comprising:

a moving condition table for defining moving conditions of said monitor camera corresponding to each of said predetermined supervisory points, wherein said monitor control means controls movements of said monitor camera by referring to said moving condition table.

3. The supervisory camera system according to claim 2, wherein said moving conditions include at least any one of a panning value, a tilting value, and a zooming value.

4. The supervisory camera system according to claim 1 further comprising:

means for selecting an individual monitoring mode and a random monitoring mode; and means for compulsory switching said individual monitoring mode to said random monitoring mode if said individual monitoring mode has been continuously selected for a prescribed time period or more.

5. The supervisory camera system of claim 1, further comprising:

a monitor for displaying images from said video camera.

6. The supervisory camera system of claim 1, further comprising:

means for selecting a random time period of monitoring said selected predetermined supervisory point, wherein said monitor control means causes said camera to monitor said selected predetermined supervisory point for a duration equal to said random time period.

7. A method of controlling a monitor camera comprising the steps of:

generating a random number;

selecting one of a plurality of predetermined supervisory points based on said random number;

comparing said selected supervisory point against the previously selected supervisory point and reselecting another predetermined supervisory point if said selected supervisory point and the previously selected supervisory point are the same; and causing said monitor camera to monitor said selected supervisory point during a monitoring period.

8. The method of claim 7, further comprising the step of:

selecting a random monitoring period of monitoring said selected supervisory point; and causing said monitor camera to monitor said selected supervisory point during said random monitoring period.

9. A supervisory camera system, comprising:

a camera; and a controller which randomly selects one of a plurality of predetermined supervisory points and commands said camera to monitor said selected predetermined supervisory point for a period of time and prevents the same predetermined supervisory point from being monitored for two consecutive time periods.

10. The system of claim 9, wherein said controller comprises:

a random number generator which provides a random number;

means for selecting said selected supervisory point from said plurality of supervisory points based upon said random number; and means for generating a randomly selected period of time, wherein said selected predetermined supervisory point is monitored for said randomly selected period of time.

11. The system of claim 10, wherein said controller comprises electronic memory containing executable program instructions; and a central processing unit that executes said executable program instructions.

12. The system of claim 10, wherein said means for selecting includes means for comparing said selected predetermined supervisory point with an immediate past selected predetermined supervisory point and reselecting a different selected predetermined supervisory point if said selected predetermined supervisory point is the same as said immediate past selected predetermined supervisory point to ensure the same supervisory point is not monitored during consecutive time periods.

13. The supervisory camera system of claim 9, wherein said controller commands said video camera to monitor another one of said plurality of predetermined supervisory points upon the expiration of said randomly selected period of time.

14. The supervisory camera system of claim 13, further comprising:

a monitor for displaying images from said video camera.

* * * * *